US006866614B2

(12) United States Patent
Pan

(10) Patent No.: US 6,866,614 B2
(45) Date of Patent: Mar. 15, 2005

(54) TRANSPORTATION WHEEL FOR A TREADMILL

(75) Inventor: Francis Pan, Taichung Hsien (TW)

(73) Assignee: Forhouse Corporation, Taichung Hsien (TW)

( * ) Notice: Subject to any disclaimer, the term of this patent is extended or adjusted under 35 U.S.C. 154(b) by 60 days.

(21) Appl. No.: 10/139,900

(22) Filed: May 7, 2002

(65) Prior Publication Data

US 2003/0036463 A1 Feb. 20, 2003

(30) Foreign Application Priority Data

Jul. 31, 2001 (TW) ..... 90212856 U

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,336,145 A * 8/1994 Keiser ..... 482/54
5,431,613 A * 7/1995 Singleton et al. ..... 482/54

* cited by examiner

*Primary Examiner*—Glenn Richman
(74) *Attorney, Agent, or Firm*—Head, Johnson & Kachigian

(57) ABSTRACT

A transportation wheel for a treadmill consists a roller and an engraved pattern defined in an outer surface the roller. The roller has an enlarged middle portion and two tapered ends on which a traveling belt is positioned. The engraved patterns are similar to fabric texture and defined on the outer surface of the roller, especially the enlarged middle portion. The engraved patterns provide an excellent guiding efficiency to keep the traveling belt from detaching from the roller.

4 Claims, 4 Drawing Sheets

TRANSPORTATION WHEEL FOR A TREADMILL

BACKGROUND OF THE INVENTION

1. Field of the Invention

The present invention relates to a transportation wheel for a treadmill, and more particularly to a transportation wheel having an engraved pattern on a roller where the pattern is similar to a pattern on the inner surface of the traveling belt. Because of the similar patterns, the transportation wheel is able to drive the traveling belt efficiently.

2. Description of Related Art

With reference to FIG. 4, a treadmill (40) has a front end and a rear end and comprises a transportation wheel (41), a freely-rotating wheel (not numbered) and a traveling belt (42). The transportation wheel (41) mounted at the front end of the treadmill (40). The freely-rotating wheel is mounted at the rear end of the treadmill (40) The traveling belt (42) is mounted around the transportation wheel (41) and the freely-rotating wheel.

The transportation wheel (41) is adapted to drive the traveling belt (42) at the same speed as the transportation wheel (41). The transportation wheel (41) comprises a roller (43), which adapts to attach a drive assembly (44) on one end of the roller (43). The roller (43) has two slightly tapered ends, an enlarged middle portion and two engraved helix patterns (45) defined on the middle portion of the outer periphery of the roller (43), wherein the engraved helix patterns are grooves and are formed in opposite directions to be a symmetrical configuration. When a user steps on the treadmill, most of the force is applied to the enlarged middle portion of the roller (43), which makes the traveling belt (42) press the middle portion tighter than the tapered ends of the roller (43). Thus, no side-force is applied to the traveling belt (42), and the traveling belt (42) is not easily detached from the roller (43). Additionally, the engraved helix patterns (45) evenly disperse the forces generated by and applied to the moving traveling belt (42) and keep the traveling belt (42) in the middle portion of the roller (43) even when the roller (43) is rotating.

However, the traveling belt (42) has an inner surface that is made of fabric and has a texture different from the engraved helix patterns (45) on the roller (43). Therefore, the roller (43) cannot provide sufficient friction to drive the traveling belt (42).

The present invention has arisen to mitigate and/or obviate the disadvantages of the conventional transportation wheel.

SUMMARY OF THE INVENTION

The main objective of the transportation wheel for a treadmill in accordance with the present invention is to keep the traveling belt on the roller of the transportation wheel.

Further benefits and advantages of the present invention will become apparent after a careful reading of the detailed description with appropriate reference to the accompanying drawings.

DETAILED DESCRIPTION OF THE INVENTION

Figure 1:
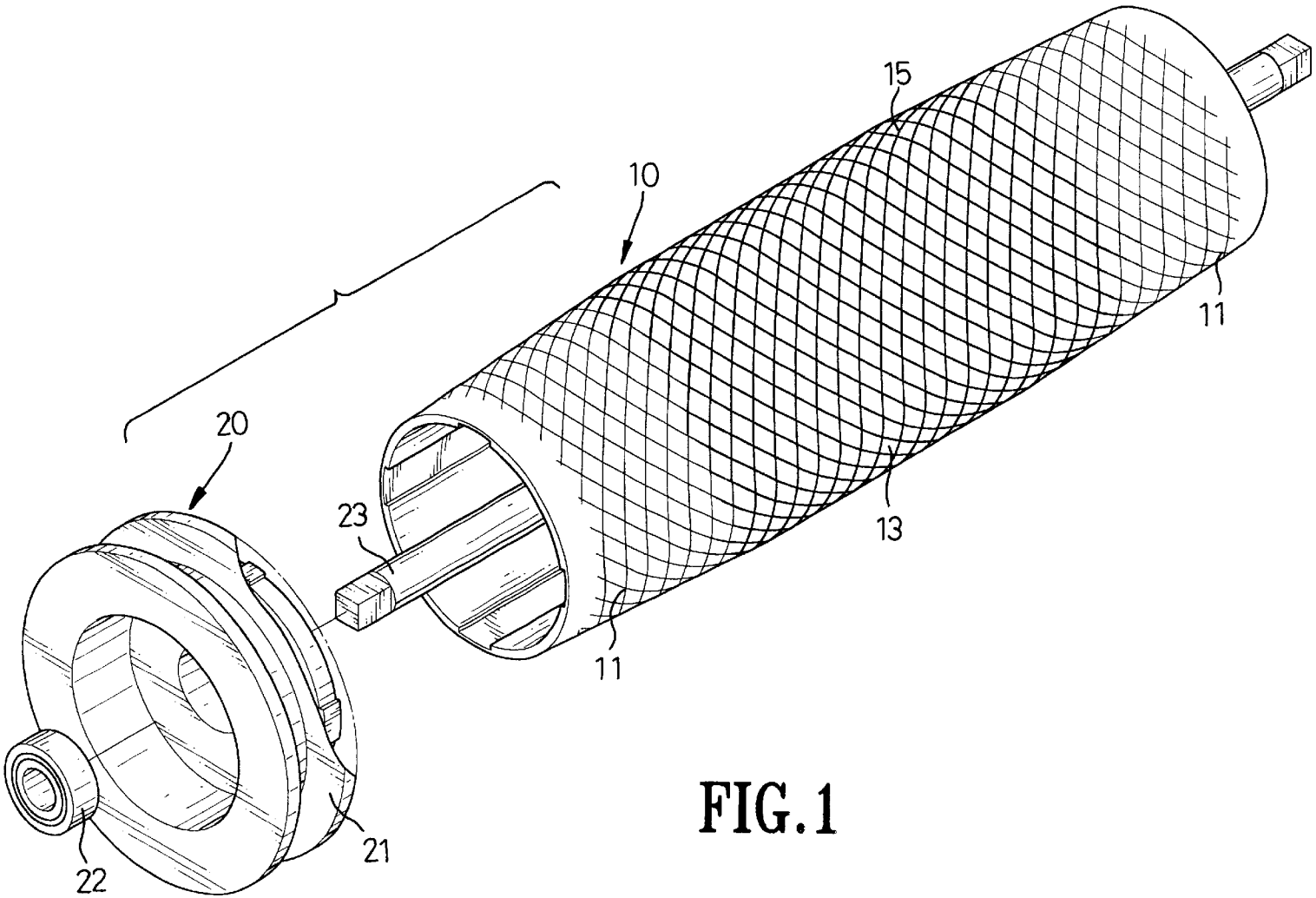
FIG. 1 is an exploded perspective view of a transportation wheel for a treadmill in accordance with the present invention.
Figure 2:
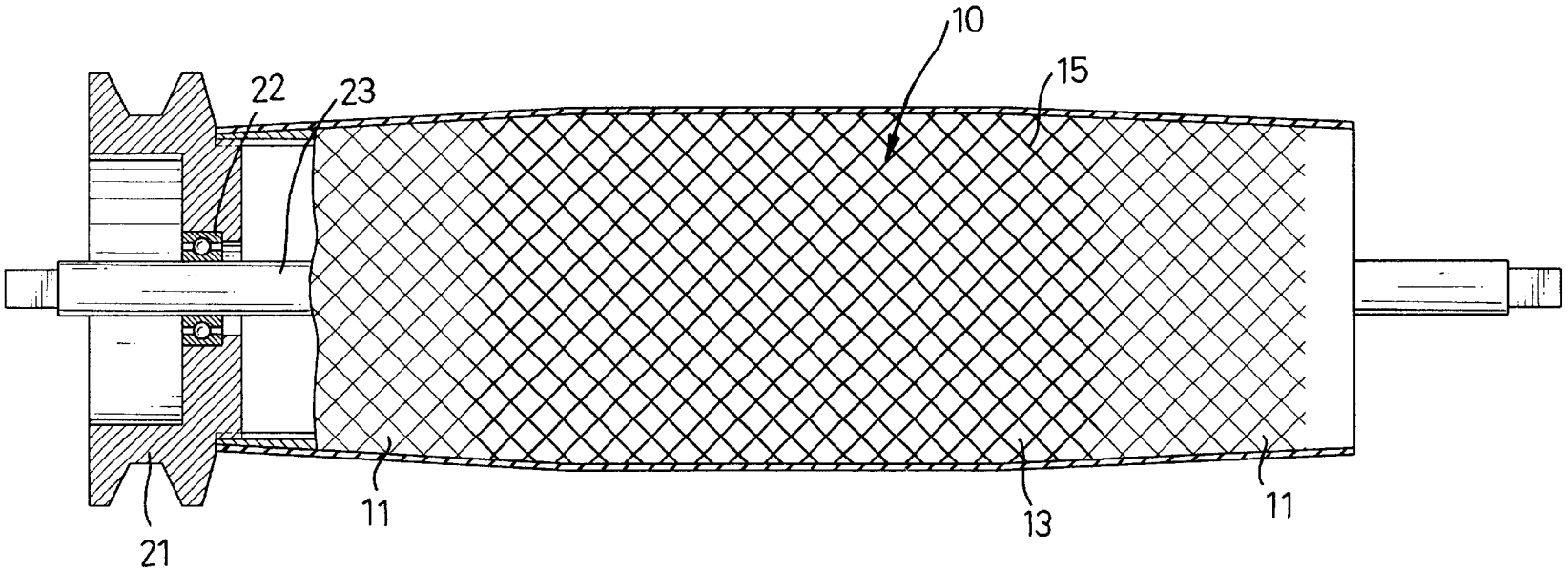
FIG. 2 is a front plan view in partial section of the transportation wheel for a treadmill in FIG. 1.

With reference to FIGS. 1 and 2, a transportation wheel for a treadmill in accordance with the present invention is adapted to drive a traveling belt of the treadmill. The transportation wheel comprises a roller (10) having two ends and an outer surface, and an engraved pattern (15) defined in the outer surface of the roller (10). The roller (10) adapts to be driven by a drive assembly (20) securing at one end of the roller (10).

The drive assembly (20) comprises two drive wheels (21), two bearing (22) and an axle (23). Each drive wheel (21) is mounted at each end of the roller (10), and a through hole (not numbered) is axially formed in each drive wheel (21). Each bearing (22) is mounted in the through hole in the respective drive wheel (21). The axle (23) passes through the roller (10) and is secured in the drive wheels (21) by the bearings (22).

The roller (10) is driven by the drive assembly (20) and comprises two tapered ends (11) and an enlarged middle portion (13). An engraved pattern (15) similar to texture of a fabric is formed around the entire outer periphery of the roller (10). The engraved pattern (15) meshes with an inner face of the traveling belt. Additionally, the engraved pattern (15) within the enlarged portion (13) is an interlacing pattern and wider and deeper than other engraved pattern (15) within the tapered ends (11) so as to enhance the friction between the roller (10) and the traveling belt.

Figure 3:
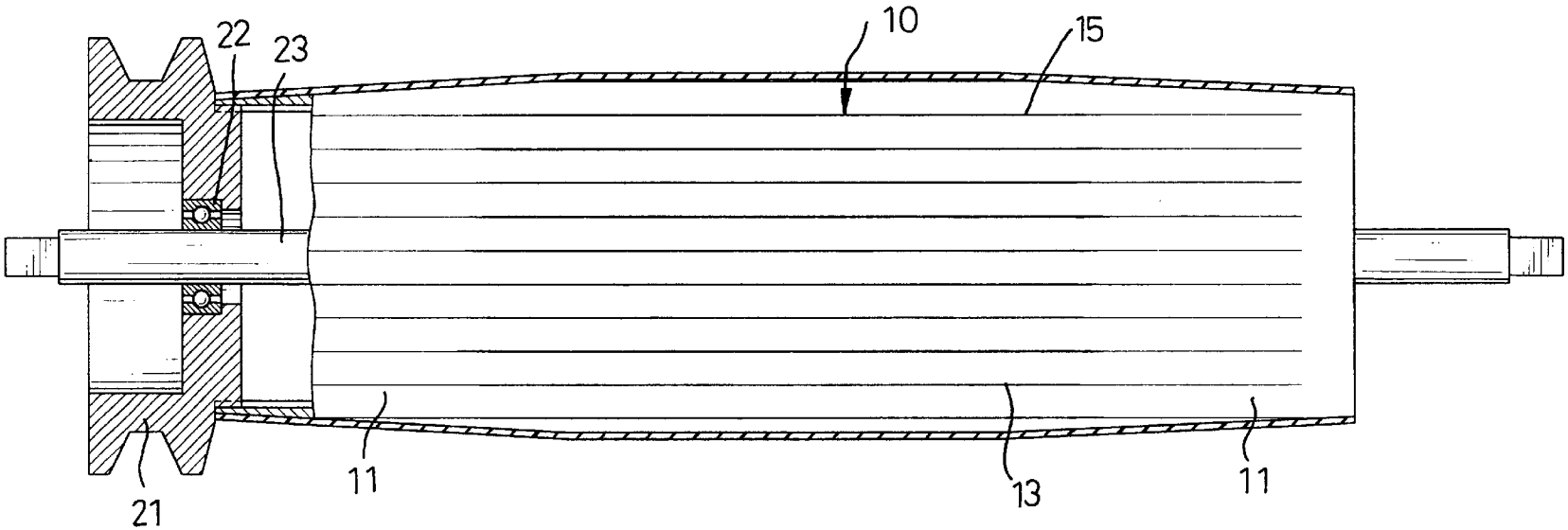
FIG. 3 is a front plan view in partial section of a transportation wheel for a treadmill in accordance with the present invention with another engraved pattern.
Figure 4:
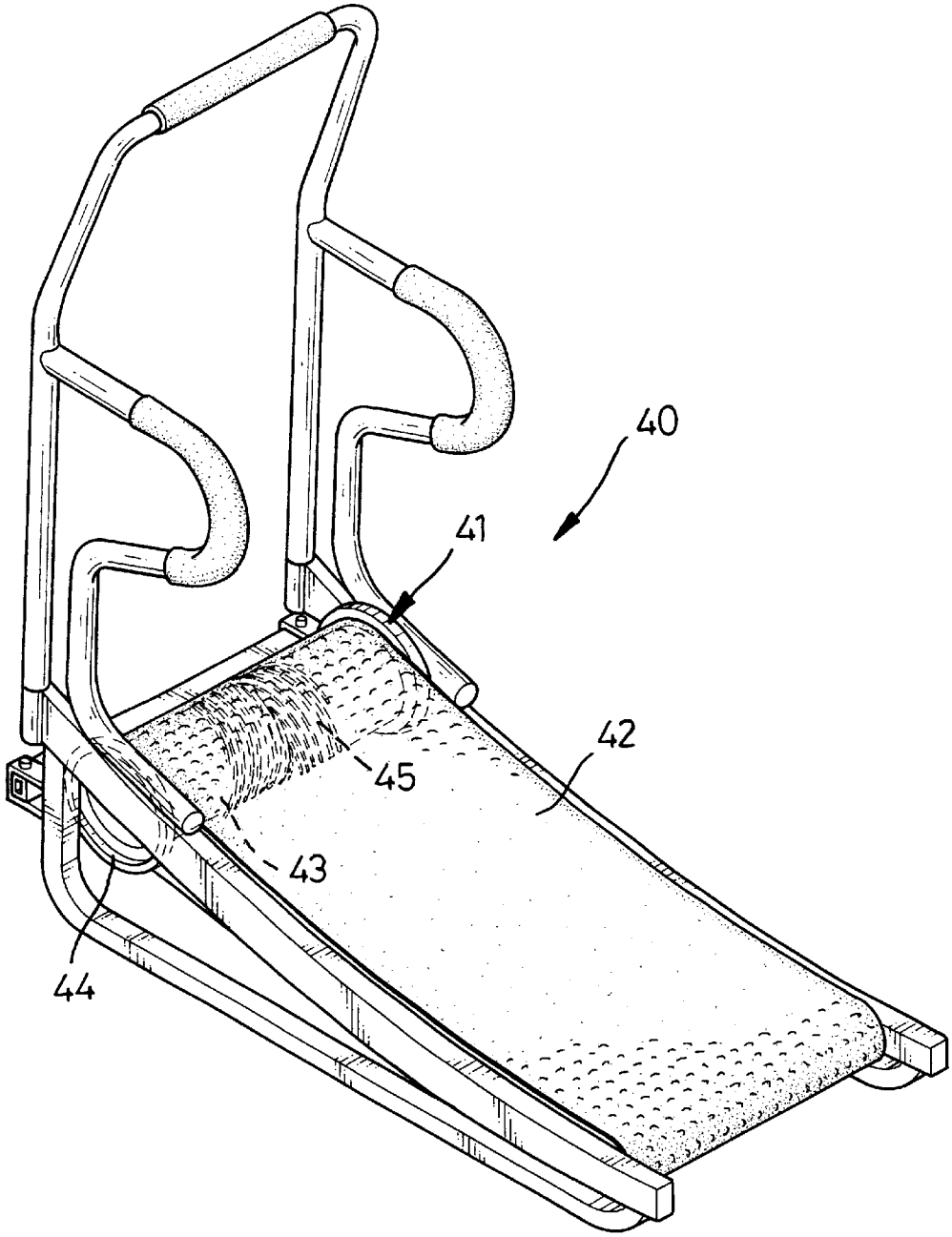
FIG.4 PRIOR ART
FIG. 4 is a perspective view of a treadmill having a conventional transportation wheel.

With reference to FIG. 3, the engraved pattern is selectively axial engraved lines, wherein the lines within the enlarged middle portion are reinforced to enhance the driving friction force between the roller (10) and the traveling belt.

The roller (10) perfectly matches the fabric inside the traveling belt. Thus the roller (10) has excellent driving efficiency to the traveling belt.

Although the invention has been explained in relation to its preferred embodiment, it is to be understood that many other possible modifications and variations can be made without departing from the spirit and scope of the invention as hereinafter claimed.

What is claimed is:

1. A transportation wheel adapted to apply on a treadmill to drive a traveling belt having an inner fabric, the transportation wheel comprising:

a roller having two tapered ends, one adapted to secure a drive assembly, an enlarged middle portion, and an outer surface having an engraved pattern defined thereon, and wherein the engraved pattern is defined in the outer surface of the roller and adapted to mesh with a texture of the inner fabric on the traveling belt.

2. The transportation wheel for a treadmill as claimed in claim 1, wherein said engraved pattern within said enlarged middle portion is wider and deeper than the engraved pattern on said tapered ends to enhance friction between said roller and the traveling belt.

3. The transportation wheel for a treadmill as claimed in claim 2, wherein said engraved pattern is an interlacing pattern.

4. The transportation wheel for a treadmill as claimed in claim 2, wherein said engraved pattern is configured as axial lines on said roller.

* * * * *